US008596026B2

(12) United States Patent
Doll et al.

(10) Patent No.: US 8,596,026 B2
(45) Date of Patent: Dec. 3, 2013

(54) VACUUM FLOW WRAP PACKAGING SYSTEM AND METHOD OF PACKAGING

(75) Inventors: Paul E. Doll, Madison, WI (US); Timothy E. Coulson, Madison, WI (US); Ronald E. Ballen, Fitchburg, WI (US)

(73) Assignee: Kraft Foods Group Brands LLC, Northfield, IL (US)

( * ) Notice: Subject to any disclaimer, the term of this patent is extended or adjusted under 35 U.S.C. 154(b) by 372 days.

(21) Appl. No.: 12/850,875

(22) Filed: Aug. 5, 2010

(65) Prior Publication Data

US 2012/0031049 A1 Feb. 9, 2012

(51) Int. Cl.
*B65B 31/04* (2006.01)
*B65B 9/10* (2006.01)

(52) U.S. Cl.
USPC ..... 53/433; 53/405; 53/408; 53/450; 53/553

(58) Field of Classification Search
CPC ..... B31B 1/64; B65B 31/02
USPC ..... 53/79, 86, 405, 408, 433, 450, 553
See application file for complete search history.

(56) References Cited

U.S. PATENT DOCUMENTS

| | | | | |
|---|---|---|---|---|
| 2,546,059 | A | | 3/1951 | Cloud |
| 2,672,268 | A | | 3/1954 | Bower |
| 2,863,266 | A | | 12/1958 | Moore |
| 2,951,324 | A | | 9/1960 | Podlesak et al. |
| 3,113,874 | A | | 12/1963 | Baush et al. |
| 3,216,832 | A | * | 11/1965 | King ..... 53/405 |
| 3,254,467 | A | * | 6/1966 | Garrow et al. ..... 53/432 |
| 3,423,902 | A | | 1/1969 | Stoop |
| 3,511,020 | A | * | 5/1970 | Jahnke et al. ..... 53/512 |
| 3,628,576 | A | | 12/1971 | Owen |
| 3,636,678 | A | * | 1/1972 | Maros et al. ..... 53/412 |
| 3,735,551 | A | * | 5/1973 | Pratt ..... 53/433 |
| 4,044,524 | A | | 8/1977 | Segale et al. |
| 4,148,933 | A | * | 4/1979 | Janovtchik ..... 426/402 |
| 4,221,101 | A | | 9/1980 | Woods |
| 4,294,859 | A | * | 10/1981 | Lundquist et al. ..... 426/410 |
| 4,371,553 | A | * | 2/1983 | Gilling et al. ..... 426/124 |
| 4,372,097 | A | * | 2/1983 | Wyslotsky ..... 53/405 |
| 4,457,124 | A | * | 7/1984 | Hartmann ..... 53/512 |
| 4,601,159 | A | | 7/1986 | Mugnai |
| 4,964,259 | A | * | 10/1990 | Ylvisaker et al. ..... 53/433 |

(Continued)

*Primary Examiner* — Hemant M Desai
*Assistant Examiner* — Gloria R Weeks
(74) *Attorney, Agent, or Firm* — Fitch, Even, Tabin & Flannery LLP

(57) ABSTRACT

A method and packaging system for forming a sealed vacuum package having minimal residual air remaining. At least one vacuum lance is provided in the interior of a partially-formed package to withdraw the air, the package being closed on three sides and having a fourth side open for insertion of the vacuum lance. An air restriction can be provided along the fourth side to form a closed edge that prevents ingress of air into the package interior after the evacuation of air. In one aspect, the air restriction may comprise a pair of pinch rollers that compress the package at the fourth side edge to form a pinch seal that provides a relatively airtight air chamber inside of the package prior to and during sealing of the package. In another aspect, the air restriction may comprise a partial seal formed around the lances to prevent or minimize air from reentering the package. In yet another aspect, the air restriction may comprise a compressed air seal formed by an air compression device that keeps the ends of the film pressed together.

18 Claims, 8 Drawing Sheets

(56) References Cited

U.S. PATENT DOCUMENTS

| | | | | | |
|---|---|---|---|---|---|
| 5,107,658 | A | | 4/1992 | Hustad et al. | |
| 5,112,632 | A | * | 5/1992 | Meli et al. | 426/392 |
| 5,263,520 | A | | 11/1993 | Arai | |
| 5,282,349 | A | * | 2/1994 | Siegel | 53/433 |
| 5,454,208 | A | * | 10/1995 | Kawano | 53/410 |
| 5,460,844 | A | | 10/1995 | Gaylor | |
| 5,491,957 | A | | 2/1996 | Maskell | |
| 5,502,946 | A | * | 4/1996 | Storandt | 53/410 |
| 5,551,213 | A | * | 9/1996 | Koelsch et al. | 53/434 |
| 5,590,509 | A | * | 1/1997 | Esteves et al. | 53/432 |
| 5,699,838 | A | | 12/1997 | Catallo et al. | |
| 5,701,724 | A | * | 12/1997 | Meli et al. | 53/451 |
| 5,711,136 | A | * | 1/1998 | Carcano | 53/434 |
| 5,846,582 | A | | 12/1998 | Mayfield et al. | |
| 5,846,825 | A | * | 12/1998 | Yamamoto | 435/351 |
| 6,123,969 | A | * | 9/2000 | Sjoberg | 426/410 |
| 6,644,361 | B2 | * | 11/2003 | Otsubo | 141/65 |
| 6,662,527 | B1 | | 12/2003 | Suga | |
| 7,076,930 | B2 | * | 7/2006 | Rimondi | 53/433 |
| 7,316,101 | B1 | | 1/2008 | Nguyen et al. | |
| 7,490,452 | B2 | | 2/2009 | Alipour et al. | |
| 2001/0011445 | A1 | * | 8/2001 | Scolaro | 53/433 |
| 2002/0083683 | A1 | | 7/2002 | Suga | |
| 2008/0010944 | A1 | | 1/2008 | Lerner et al. | |
| 2010/0257820 | A1 | * | 10/2010 | Doll et al. | 53/433 |

* cited by examiner

VACUUM FLOW WRAP PACKAGING SYSTEM AND METHOD OF PACKAGING

FIELD

This application generally relates to a vacuum flow wrap system and, in particular, a vacuum flow wrap system having reduced residual air in the final package.

BACKGROUND

Packaging of products, such as products in a shingled arrangement, can involve arranging the products on a tray or bottom web of film and overlaying with a top web of film to seal or cover the products. To ensure a hermetic and tight seal, it is common to draw a vacuum inside the package to form a vacuum sealed package. One such method of vacuum sealing the package is to seal the package along three edges, or if one is a fold, along two edges, and insert a vacuum device into the package through the unsealed portion in order to withdraw the air from the interior of the package. The vacuum device is then removed, and the package is subsequently sealed at its unsealed portion. One drawback with this method is that during the time it takes to remove the vacuum device and to subsequently seal the package, the potential exists for air to reenter the package. Various solutions to prevent air from reentering have included clamping the package opening closed until the air is evacuated; however, upon removing the clamp for sealing, the air can reenter the package.

Another method is to use vacuum on a flow wrapper package to produce a tight film over the product. However, a true vacuum can be difficult to achieve because air can get into the package from the folding box location. The film is folded around the folding box to provide a fold in a web of film to create two opposing panels to form two sides. As air is evacuated downstream of the folding box, it still can reenter from the folding box location because it is not yet sealed at the side edges adjacent the folding box.

Current vacuum package technology can utilize a vacuum tube having only an opening at its end to draw the vacuum. This single opening can pull on the film making it tighter at one spot, i.e., the spot where the single hole is, and can cause the film to wrinkle or bulge and to not lay flat when being sealed around the product, as well as being pulled tighter in one spot versus another.

Another method of vacuum sealing comprises evacuating air from a package while in an air tight chamber. First, the package containing the product therein is placed within the air chamber. Then, the air within the chamber is first evacuated, which subsequently evacuates the air inside of the package. The package can be sealed at the opening from which the air has been evacuated while still in the chamber, thus ensuring that the package remains generally free of air. However, this proves to be a time consuming process, taking significant time to evacuate air from the package because both the chamber and package have to be evacuated and resulting in much more air that has to be removed.

SUMMARY

A method of forming a vacuum package for a packaged product and its related packaging system is provided herein that removes excess air from the package such that minimal air remains within the interior of the package. The air is removed from the package interior by providing vacuum lances to withdraw air from the interior of the package, which is sealed or closed on at least three sides, in combination with providing an air restriction or barrier along a trailing edge of the package, or the fourth side, through which the vacuum lances are inserted, the lances extending past the air restriction or barrier. The fourth side air restriction can provide an airtight chamber bound by the sealed or closed sides and the air restriction, thus, being effective for preventing entry of air to the interior once the air has been withdrawn by the lances. Upon removing the excess air, the package is essentially immediately sealed such that the air cannot reenter the package.

A vacuum sealing station conveys the product onto a bottom or lower web of film which is then overlayed by an upper web of film. Alternatively, a single web of film may be used and folded to create a lower and an upper web of film from the single web of film. The upper and lower web of film encasing the product therebetween, is then passed between a pair of sealing rollers that form a side seal on opposite sides of the package, parallel to a machine direction. Where two webs of film are utilized, then both sides are sealed; where one web of film is utilized and folded in half, only one side edge is sealed.

By one approach, after passing the side sealing rollers, the partially sealed package can be advanced to a pair of pinch rollers, which roll over and across the partially sealed package and the product therein in a machine direction, to produce a temporary, at least substantially, airtight "pinch" seal, or cross seal (i.e., transverse to the machine direction), at the rollers. An airtight chamber can be provided between the side seals or edges, the pinch rollers and a cross seal formed at a leading edge of the package by a pair of downstream sealing bars. The pair of downstream sealing bars can create both the trailing edge seal of the downstream package and the leading edge seal of the current package.

After passing through the pinch rollers, the partially sealed package can be advanced to the pair of sealing bars to form the trailing edge cross seals of the package to result in a final vacuum sealed package.

The product that is packaged in the flow wrapper package is such that it will not be damaged by passing it under the compliant pinch rollers. The pinch rollers can comprise a pair of rollers, a top and a bottom, where both can either be equally compliant to create an air tight seal between them, or one roller can be compliant while the other roller is stiffer to create the air tight seal.

The vacuum sealing station can also contain one or more vacuum lances that are inserted inside of the partially sealed package just before the pinch rollers and extend toward the pair of sealing bars. These vacuum lances can aid in pulling the film taut after passing through the pinch rollers and to continue to provide a vacuum atmosphere in the package to remove the air from the interior of the package. The vacuum lances can also have multiple holes to create a large area of suction distributed over a greater area to minimize pull on the film in any one location. The multiple openings help to prevent the film of the wrapper from getting drawn in at one spot, such that it would create a wrinkle or bulge or be tighter in one spot versus another. The multiple holes can also help to keep the film tight to the tube at a relatively even rate, yet allow the film to still pass or slide over the tube without sticking to it.

The pinch rollers can be used to close off the opening to the pouch (i.e., at the trailing edge) and roll over part of the vacuum lance. The vacuum lance can be made such that it is not damaged from the pressure of the pinch rollers passing over it. The pinch rollers help to at least substantially seal off the package at its trailing edge while the vacuum lances are evacuating the air from the package interior, downstream of the pinch rollers.

By another approach, a vacuum package system can comprise a vacuum lance or pair of vacuum lances inserted into the package without the use of pinch rollers. Instead, the unsealed trailing end portion can be partially sealed to provide the air restriction, by a heat seal or other similar sealing mechanism, around the vacuum lances to aid in preventing external air from reentering. Optionally, an external pressing device, such as an external roller that is complimentary in shape to the lance, can be applied to the outside surface of the package to roll over the top of the partially sealed package and over the top of the vacuum lance to help press the film taut against the lance and keep it smooth as the air is being withdrawn.

By still another approach, the vacuum package can have vacuum lances inserted through the trailing edge portion and the trailing edge portion can be kept at least substantially closed around the vacuum lances by use of an air knife. An air knife is a mechanism that provides a curtain of air that is blown down onto the film at the trailing edge and blows the film together to temporarily, and at least substantially, seal it, providing the temporary air restriction.

The vacuum lance may also comprise a double tube, where one tube is encased in the other. The outer tube can have multiple holes along its length to pull the film taut to the surface of the tube while the inner tube can have a single opening at its end that withdraws the air from inside of the package.

The above vacuum package systems provide a method of withdrawing air such that minimal air remains inside of the package. The film does not become wrinkled or pulled in one location versus another because an even and smooth packaging film results upon the withdrawal of the air while maintaining the film taut against the vacuum lances containing multiple air holes, if desired. Furthermore, because the packaging system is a continuous process that continuously advances the film in a machine direction, the use of the vacuum lances and air restriction are provided in such a manner as to permit the web of film to also continuously travel in a machine direction, without the film getting stuck to the vacuum lances. The configuration of the vacuum lances and other herein provided aspects of the packaging process (e.g., an external pressing device) can allow for the packages to be made using the continuous process.

DETAILED DESCRIPTION

A method and apparatus for forming a vacuum package having minimal air is described herein and provided in FIGS. 1-10. A vacuum-sealed package can be provided from the method and apparatus having the air evacuated therefrom to provide a package, in one aspect, that has at least 20 cc of air or less or a ratio of about 0.01:1 volume of residual air to surface area of product. In another aspect, the package can be provided having a ratio of about 0.001:1 volume of residual air to surface area of product. The web or webs of film that makes up the package can advance in a machine direction and receives the item to be packaged thereon. The web of film can be either sealed or closed on three sides. The fourth side, or trailing edge, can remain unsealed while the air is withdrawn from the package by the insertion of at least one, preferably two, vacuum lance tubes to withdraw the air. The trailing edge, however, can be provided with an air restriction barrier that keeps the trailing edge portion essentially closed while the vacuum lances are withdrawing the air and until the trailing edge portion is permanently sealed. The air restriction barrier can create a pinch seal that closes off the trailing edge portion to create an essentially airtight inner chamber until the trailing edge portion is permanently sealed.

In one aspect, a pinch roller can be used to provide a temporary pinch seal along the trailing edge. In another aspect, the trailing edge can be partially sealed around one or more vacuum lances, such as by sealing with a partial heat seal, without the use of a pinch roller. In yet another aspect, an air knife can be provided to supply a curtain of compressed air that pushes down on the film at the trailing edge to pinch it off from the outside air and provide a temporary air restriction or pinch seal.

The vacuum-sealed package discussed herein can comprise a flow wrapper or flow wrap package. A flow wrapper is a film that is wrapped around a product, in this case a food product. The flow wrap packaging system disclosed herein can be applied to standard flow wrappers: fin seal, 3-side seal and 4-side seal systems using standard form-fill-seal processes. The description below will generally focus on the 4-side seal system, but it can apply to any of the above.

Figure 1:
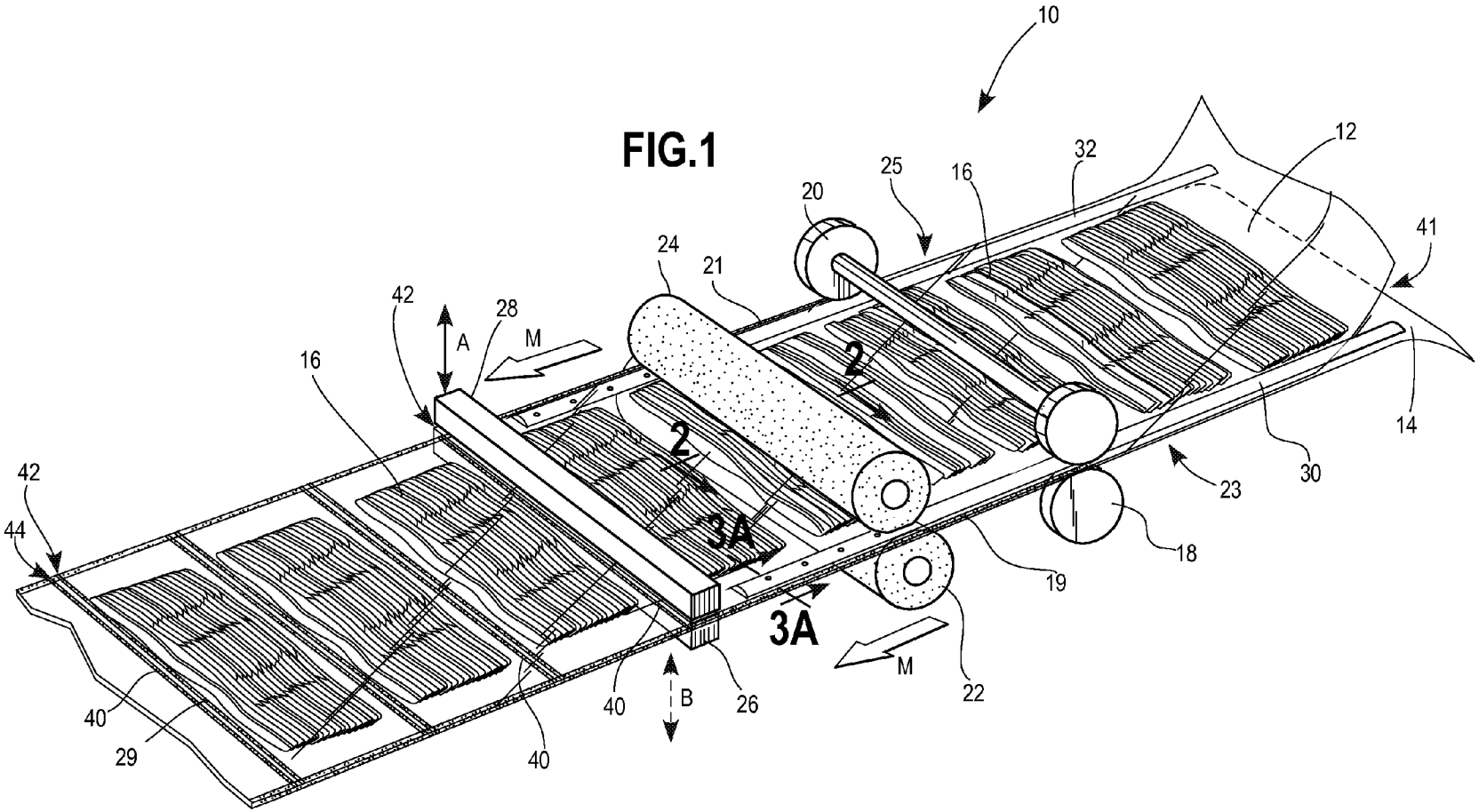
FIG. 1 is a perspective view of a first embodiment of a vacuum flow wrap packaging system.
Figure 4:
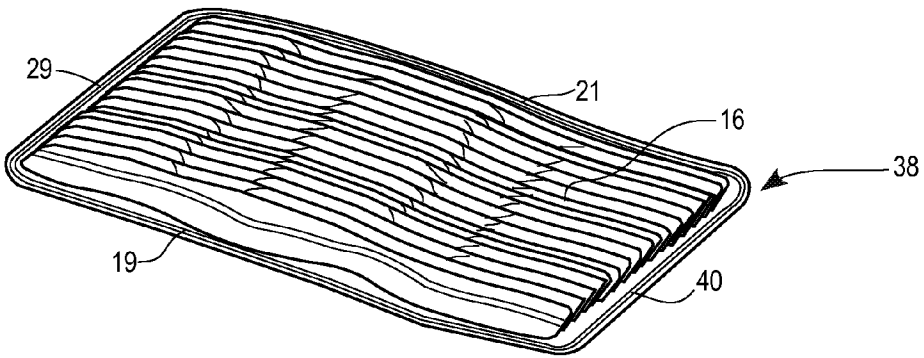
FIG. 4 is a perspective view of a package made by the system of FIG. 1.

As shown in FIG. 1, a process 10 is shown for making vacuum flow-wrap packages 38 (see FIG. 4). A web of film can be provided and, as in the process illustrated in FIG. 1, two webs of film can be provided, a bottom web or bottom film portion 14 and a top web or top film portion 12, and continuously advanced in a machine direction. The webs of film can be advanced in a relatively continuous manner that can also include intermittently advancing the webs of film in a machine direction. An item to be packaged, such as a food item 16, can be conveyed onto the bottom film portion 14. The top film portion 12 can be overlaid over the bottom film 14 covering the item to be packaged. Alternatively, instead of conveying the food product onto the bottom web of film, the food product can be inserted into the film that already has the bottom and top web of film connected along at least one edge, or the film can be provided to wrap around the food product. The top film 12, bottom film 14 and food item 16 can all be advanced in a machine direction, M, toward a longitudinal edge-sealing station. In one aspect, the longitudinal edge-sealing station can be a pair of side seal rollers 18 and 20. The side seal rollers 18 and 20 can be continuously rolling in a machine direction such that the side seal rollers 18 and 20 are continuously forming the side seals 19 and 21 of the package 38 by heat-sealing the side edges 23 and 25 of the film together. The side seal rollers 18 and 20 generally only contact the web of film at the side edges 23 and 25 of the film, thus allowing the middle of the film containing the food item 16 to pass underneath the side seal rollers 18 and 20 without contacting it.

At least one vacuum lance and, in particular, two vacuum lances can be provided in the interior or product-containing segment of the package 38, prior to forming the temporary pinch seal, to withdraw air from the interior of the partly-formed package such that the majority of the residual air is removed. In one aspect, the amount of residual air that may remain inside of the interior of the partly-formed package can be about 20 cc of air or less and, preferably, 10 cc of air or less. A pair of vacuum lances 30 and 32 can extend from the opening 41, just upstream of the side-seal rollers 18 and 20, past (and between) the pinch rollers 22 and 24, and up to the heat-sealing bars 26 and 28. Alternatively, the vacuum lances 30 and 32 may extend from downstream of the side-seal rollers 18 and 20 instead, however, any appropriate positioning can be provided. The vacuum lances 30 and 32 can be positioned on opposite sides of the package interior, such that one vacuum lance 30 is positioned adjacent one side edge 23 and the other vacuum lance 32 is positioned adjacent the opposite side edge 25, however, any other appropriate arrangement is possible. In particular, the lances are positioned such that they extend adjacent the food product and do not contact or extend over the food product. The vacuum lances 30 and 32 can extend up to the heat-sealing bars 26 and 28, and can end just before contacting the heat-sealing bars 26 and 28. The vacuum lances 30 and 32 can be kept stationary, while the film moves over them.

The vacuum lances 30 and 32 can comprise a material, such as a plastic material or metal tube, that can withstand the compression of the pinch rollers 22 and 24 passing over them without pinching the lances 30 and 32 or causing damage to the lances 30 and 32. The vacuum lance 30 or 32 can also still draw a vacuum even after the pinch seal is made by the pinch rollers 22 and 24 passing over the vacuum lances 30 and 32.

Figure 3A:
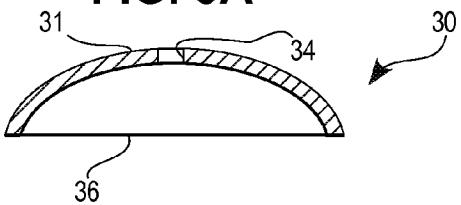
FIG. 3A is a cross-sectional view of the vacuum lance taken along the line 3A-3A of FIG. 1.
Figure 3B:
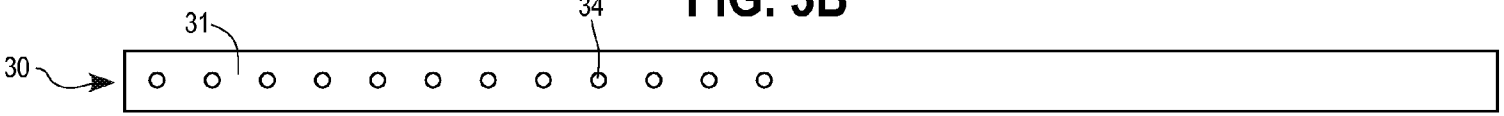
FIG. 3B is a top plan view of one of the vacuum lances of FIG. 1.

Optionally, the vacuum lances 30 and 32 can have multiple ports or openings 34 along the length of the lance body or along at least a portion of the lance body, as illustrated in FIGS. 3A and 3B. At a minimum, the multiple openings are positioned along the lance body in the area of the relatively airtight chamber formed by the three closed edges and the temporary pinch seal along the fourth edge. The multiple openings 34 can provide a slight vacuum sufficient to draw the film slightly down onto the surface of the vacuum lance, yet remain loose enough to allow the film to move across the surface of the lance as the process advances in the machine direction. The multiple holes 34 help to prevent the film from getting drawn in at one spot, such that it would create a wrinkle or bulge in the film, or be tighter in one spot versus another. The multiple holes 34 can permit the film to continue to advance in the machine direction at a relatively even rate without getting stuck to the holes or the lance 30 or 32.

Alternatively, one vacuum lance may be used, and still alternatively, a pair of lances can be used where one lance can draw a vacuum and the other lance can provide an inert gas useful when performing modified atmosphere packaging (MAP). A modified atmosphere gas and/or typical atmospheric gas, such as a first gas substance or mixture, effective to provide a sustainable environment for a food product can be provided in one of the lances or tubes. A modified atmosphere gas can comprise any inert gas or non-atmospheric gas that can result from modified atmosphere packaging (MAP). MAP can be carried out during the packaging process where the air can be displaced by the modified atmosphere via gas flushing from the MAP lance. These harmless inert gases can be obtained from air and can satisfy high purity requirements.

Inert gases that can be introduced to flush the interior space of the package can include, in one aspect, nitrogen, carbon dioxide, carbon monoxide, or any combination thereof. In one aspect, an inert gas or gases can be used to flush the interior of the package such that about 1% or less of residual oxygen remains. In another aspect, less than about 0.5% oxygen remains inside of the package. At any rate, the amount of residual oxygen that remains in the package can be determined by the packaging requirements of the product being packaged and/or by the process or equipment capabilities.

After the side seal rollers 18 and 20 have formed the side seals 19 and 21, the top and bottom webs of film 12 and 14 containing the food item 16 therebetween are advanced in a machine direction M toward a pinch-seal forming device, such as a pair of pinch rollers 22 and 24. The pinch rollers can comprise a bottom roller 22 that contacts the bottom web of film 14 and a top roller 24 that contacts the top web of film 12. The pinch rollers 22 and 24 can comprise sponge or sponge-like rollers having any appropriate sponge material that provides adequate compression force yet is soft or compliant enough that it does not damage the item 16 packaged therein. In one aspect, the top roller 24 and the bottom roller 22 can be equally compliant and can create an air tight seal between them. In another aspect, the top roller 24 can be a compliant roller and the bottom roller 22 can be made of a stiffer material. This arrangement can be used for products that have a fairly flat or stiff bottom. In yet another aspect, the opposite may be true.

Figure 2:
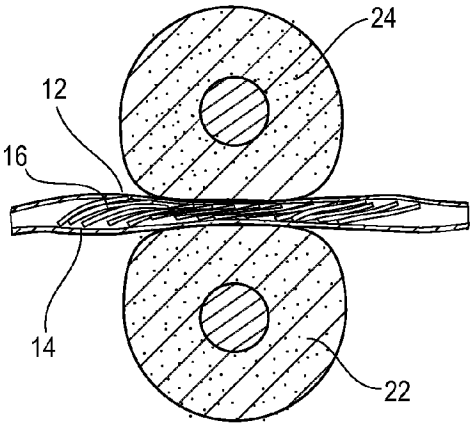
FIG. 2 is a cross-sectional view of a pair of pinch rollers taken along line 2-2 of FIG. 1.

As the top film 12, the food item 16, and the bottom film 14 are advanced between the pinch rollers 22 and 24, the rollers 22 and 24 can compress the top film 12, the food item 16, and the bottom film 14 slightly, as illustrated in FIG. 2, without damaging the food item 16.

The pinch rollers 22 and 24 can be used to close off the opening 41, i.e., the trailing end adjacent the pinch rollers 22 and 24, in the partly-formed package, thus essentially forming a temporary air restriction, such as an airtight pinch seal. The pinch seal created by the pinch rollers 22 and 24 can create a generally airtight chamber between the pinch rollers 22 and 24, the side seals 19 and 21, and a heat-sealing station 26 and 28 downstream of the pinch rollers 22 and 24, to be discussed in more detail below.

The heat-sealing or cross-sealing station can comprise a pair of heat-sealing bars 26 and 28 that can create a leading edge end seal 29, which is a cross-seal transverse to the machine direction at the leading edge 42 of the package. The pair of heat-sealing bars 26 and 28 reciprocate away and toward each other in the direction of arrows A and B, such that the bars only contact the film long enough to make a seal therebetween and then reciprocate apart to allow the rest of the film to travel in a machine direction between the retracted sealing bars 26 and 28. As the heat-sealing bars 26 and 28 create the leading edge end seal 29 they can also relatively simultaneously create the trailing edge end seal 40 at the trailing edge 44 of the previous package 38. Thus, a first leading edge end seal 29 can be made for a first package. Then, as the film is advanced a trailing edge end seal 40 can be made followed relatively simultaneously by the leading edge end seal 29 of the next subsequent package. After the leading edge end seal 29 is made, the package 38 then can contain three side seals; the leading edge seal 29, the side seal 19 and the opposite side seal 21. Only the opening 41 remains unsealed, however, it is closed off by the previously formed pinch seal made by the pinch rollers 22 and 24.

As the partly-sealed package advances in the machine direction, the trailing edge portion 44 eventually passes underneath the heat-sealing bars 26 and 28 and the trailing edge end seal 40 is created to close off the opening 41 upstream of the trailing edge end seal 40, thus forming a completely-sealed package 38. Prior to sealing of the trailing edge portion 44, air is not permitted to reenter the interior of the package due to the relatively airtight chamber that was created between the seals and the pinch rollers 22 and 24, the air having already been evacuated by the vacuum lances, resulting in a series of connected packages having reduced residual air remaining, and in some case, 20 cc or less of air remaining. The connected packages can be singulated from one another using any known separation method to separate the connected packages at or between adjacent end seals, i.e., adjacent leading edge seal 29 and trailing edge seal 40, to form a single, vacuum-sealed package 38. In one aspect, a blade or other similar cutting system can be used to separate the connected packages. Thus, the final package 38 can also maintain a residual air level of about 20 cc or less and, in particular, about 10 cc or less.

Figure 5:
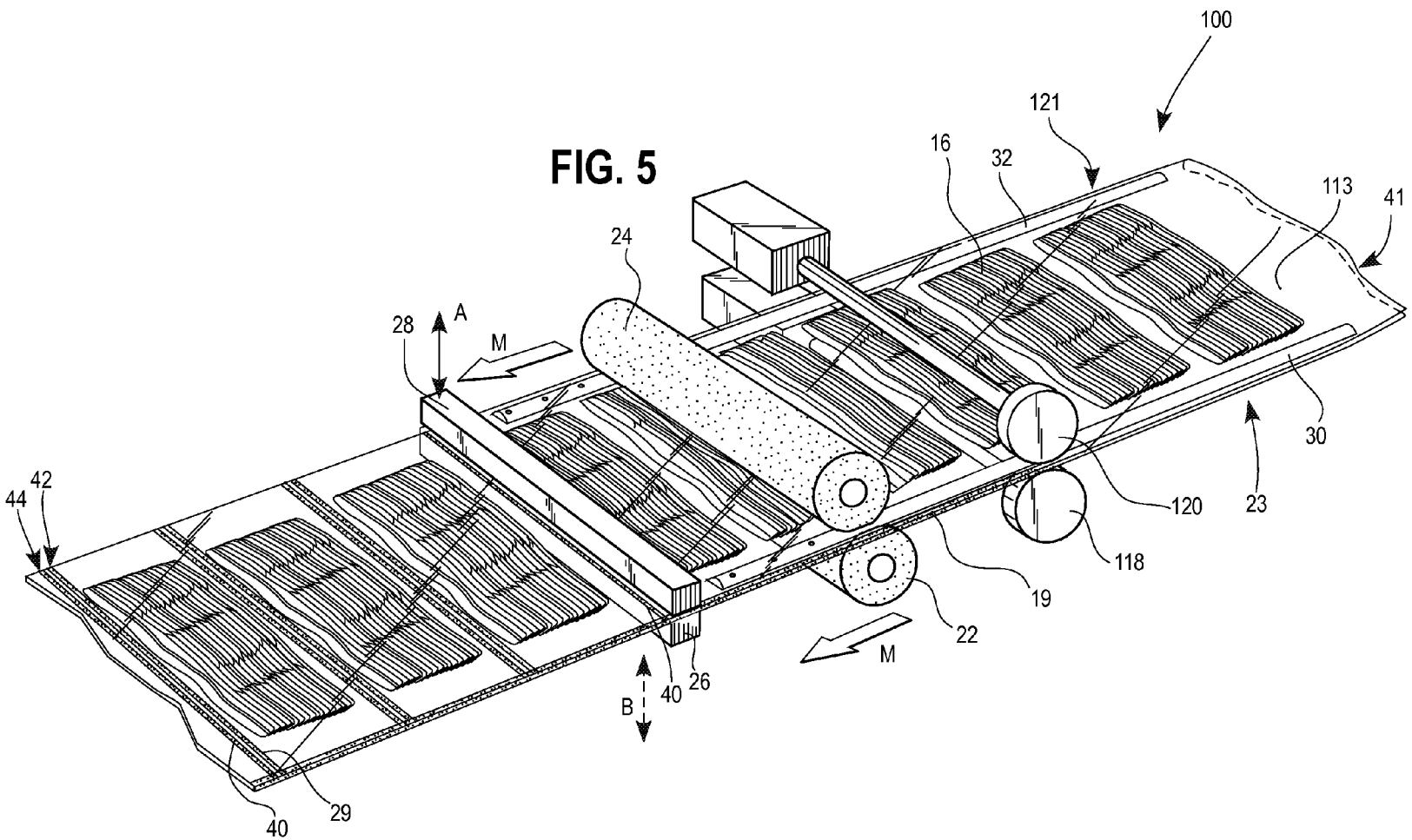
FIG. 5 is a perspective view of a second embodiment of a vacuum flow wrap packaging system.

Additionally, the method described herein can also apply to a 3-sided seal package or a fin sealed package. In a fin seal package, the package would only have one seal in the machine direction, therefore, only one running seal or side seal, with the opposite side being a fold, as illustrated in FIG. 5. Thus, in the 4-sided seal package, one of the side seals can include a fold, such that when a seal is referenced it can also refer to a fold. For instance, one of the side seals can instead be a fold 121, such that the top web 12 can be joined by a fold 121 to the bottom web 14, and the opposite side edge 23 would still be formed into a side seal 19. The transverse seals, i.e., the leading edge end seal 29 and the trailing edge end seal 40, can be made by the heat-sealing bars 26 and 28, as in the previous aspect. Regardless of which type of sealed package is created, i.e., fin seal or 4-side seals, etc., this method can provide a package that has three sides sealed or closed (i.e., the two side edges 23 and 25 and the leading edge 42) with the fourth side having a pinch seal created by the temporary air restriction, such as the pinch rollers 22 and 24 in this case, that can be later sealed.

Figure 6:
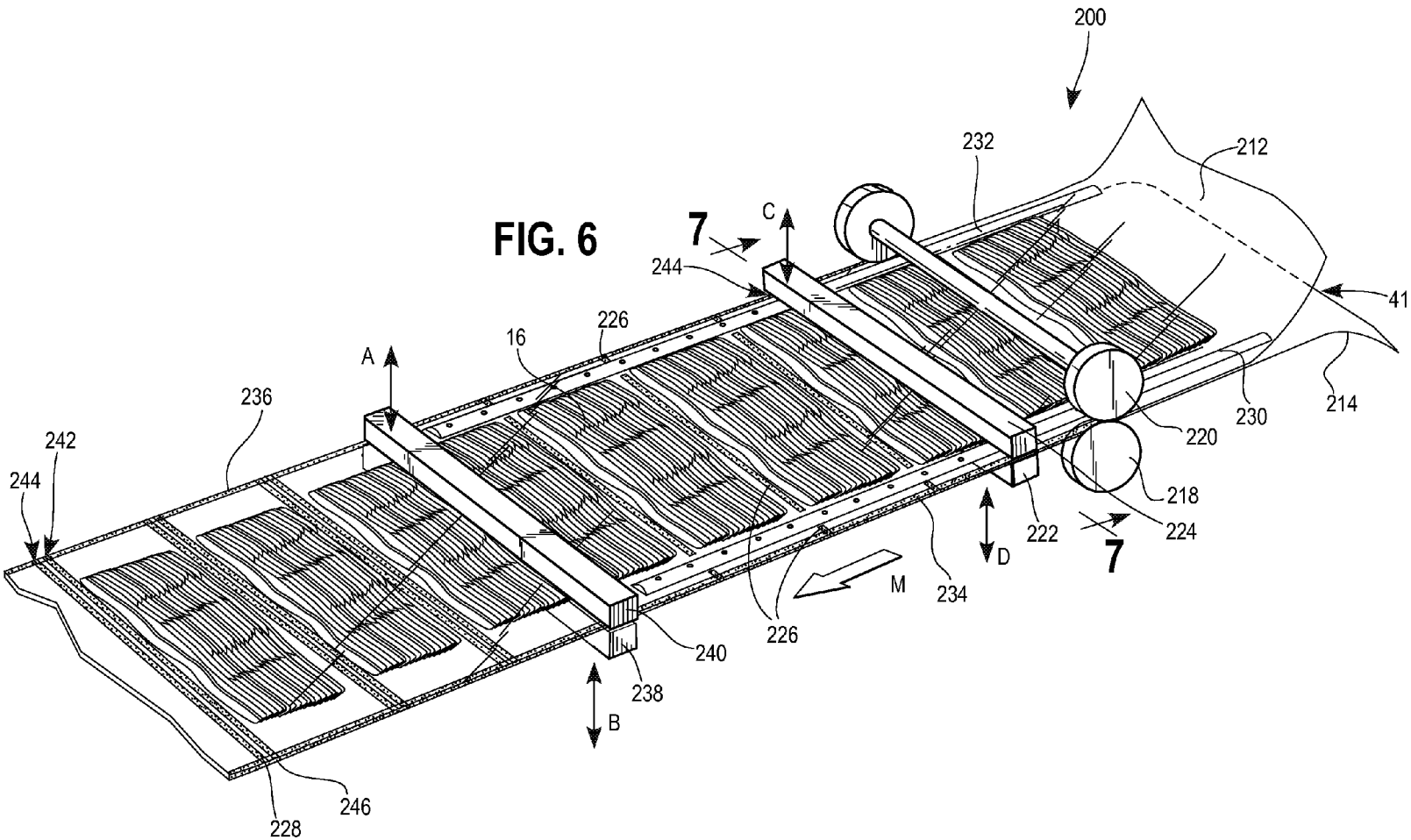
FIG. 6 is a perspective view of a third embodiment of a vacuum flow wrap packaging system.
Figure 7:
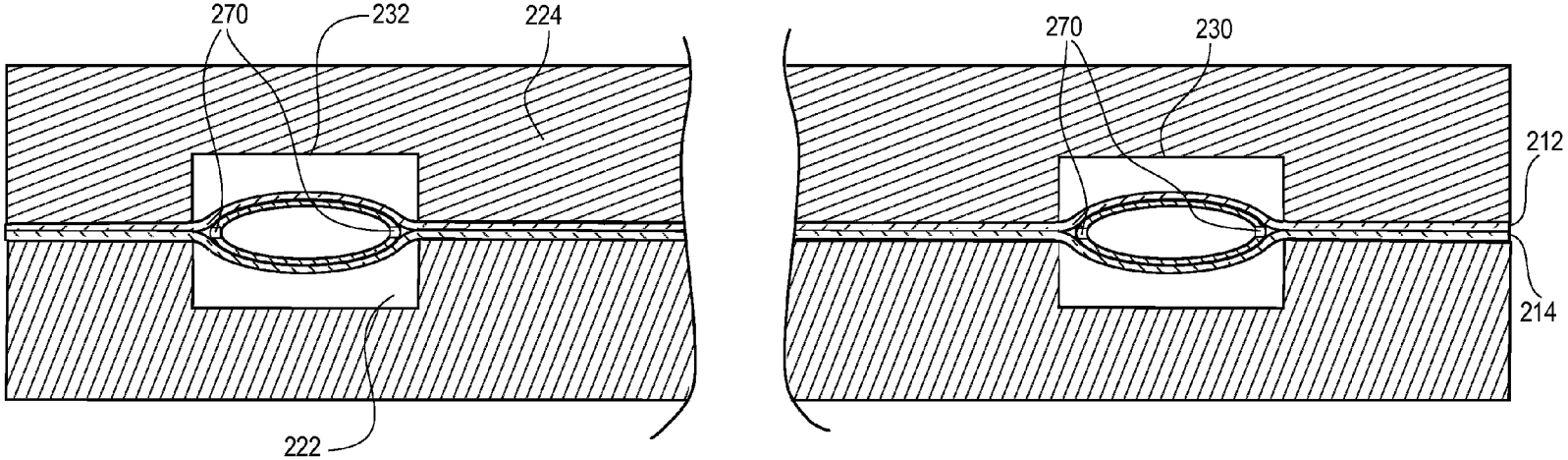
FIG. 7 is a cross-sectional view of a pair of sealing bars taken along line 7-7 of FIG. 6.

Alternatively, in another approach the pinch rollers can be eliminated altogether and instead the air restriction can be provided by a partial seal 226 made around a pair of vacuum lances 230 and 232, as shown in FIG. 6, to provide the air restriction. The pair of vacuum lances 230 and 232 function as the air evacuation device. A first heat-sealing station can be used to form the partial seal 226. In one aspect, the first heat-sealing station can comprise a pair of partial sealing bars 222 and 224, such that a portion of the bar 222 and 224 does not contact the vacuum lance tubes 230 and 232, such that the bar can contain a cut-out section, as shown in FIG. 7. The partial sealing bars 222 and 224 can reciprocate towards and away from each other in the direction of arrows C and D to form intermittent partial seals 226 that are non-continuous across the width of the film. The partial seal 226 can create a substantially airtight seal at the trailing end portion 244 of the partially-formed package, leaving just enough room for the vacuum lances 230 and 232 to extend into the partially-formed package. The partial seal 226 can create enough of a seal to prevent air from reentering the partially-formed package. Alternately, the partial seal 226 can also be at the leading edge portion 242 of the partially-formed package, especially if the process has just begun advancing the film down the process line.

The side seals 234 and 236 are formed similarly to the previous approaches in FIGS. 1-4, where a pair of side seal rollers 218 and 220 can be provided to form the side seals 234 and 236. The leading end 242 is also sealed in a similar manner to the previous approaches in FIGS. 1-4, where a pair of cross-seal bars 238 and 240 can be provided as a second heat-sealing station to form the leading edge end seal 246. The cross-seal bars 238 and 240 can also form a complete seal 228 where the partial seal 226 was positioned. The cross-seal bars 238 and 240 can also relatively simultaneously form the complete seal 228 out of the partial seal 226 and the leading edge seal 246 for the subsequent package. The cross-seal bars 238 and 240 can also reciprocate away and toward each other in the direction of arrows A & B to form intermittent end seals.

Figure 10:
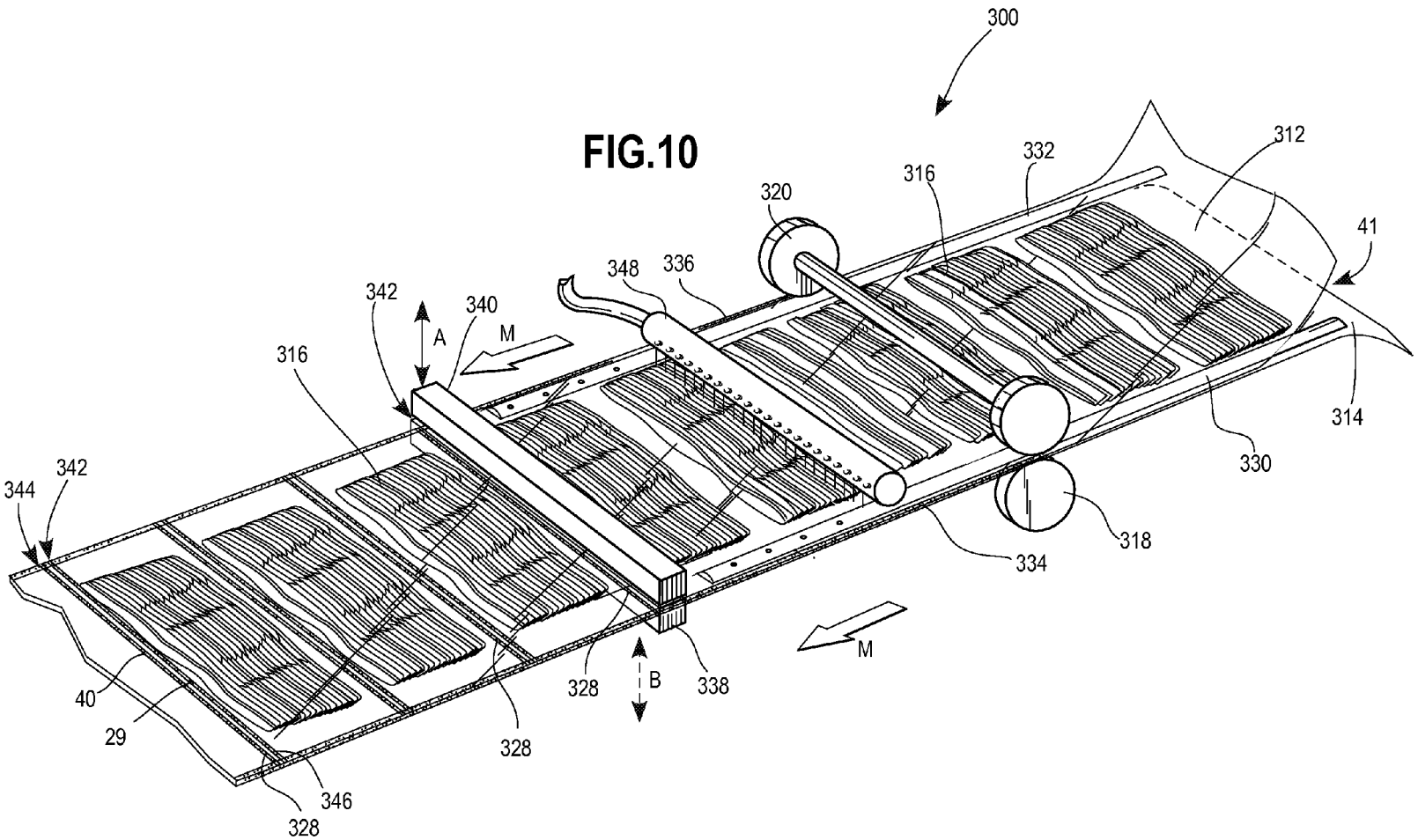
FIG. 10 is a perspective view of a fourth embodiment of a vacuum flow wrap packaging system.

In yet another approach, the temporary air restriction can be provided by a compressed air curtain, as shown by the process 300 in FIG. 10. The compressed air 348 curtain, or air knife, can be positioned at the trailing edge portion 344, just after passing the longitudinal edge-sealing station 318 and 320. The compressed air can be provided such that it is directed at the film at the trailing edge portion 344 of the respective partially-formed package. The compressed air can be directed at the film using any appropriate method, such as using an air knife. An air curtain 348 can contain a series of holes therein, through which the air is passed. As the air is directed at the film it pushes down on the film at the trailing end portion 344 to form an air restriction or pinch seal, yet leaving just enough room for the vacuum lances 330 and 332 to fit through the opening. As the partially-formed package advances down the process line, the trailing edge portion of the partially-formed package can be sealed at the heat-sealing station 338 and 340 while the temporary air restriction remains in place and provides for a relatively airtight chamber for the next package behind it.

The vacuum lances 230 and 232 can comprise a single tube with a single opening at its end for drawing a vacuum therethrough. The addition of the partial seals 226 helps to create a relatively airtight chamber in an interior of the package once the other three edges, the two sides and the leading edge, are all sealed or closed (i.e., a folded edge).

Figure 8A:
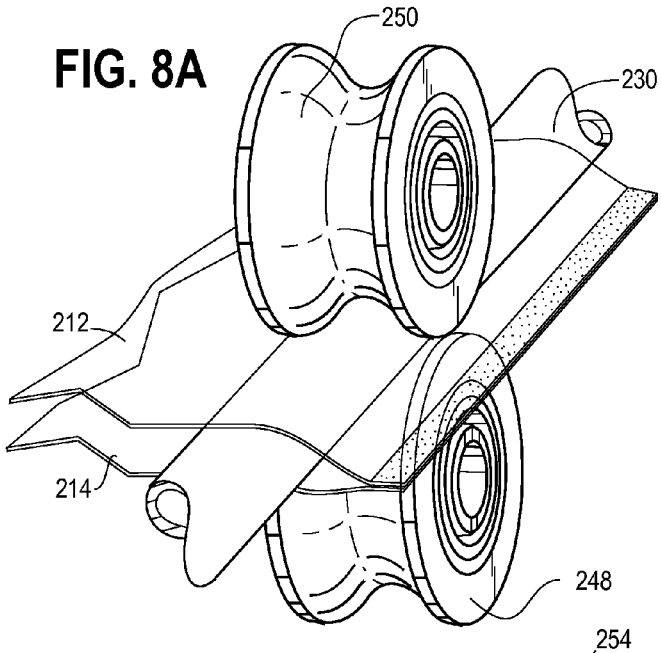
FIG. 8A is a perspective view of a first embodiment of an external roller on the outside of the package.
Figure 8B:
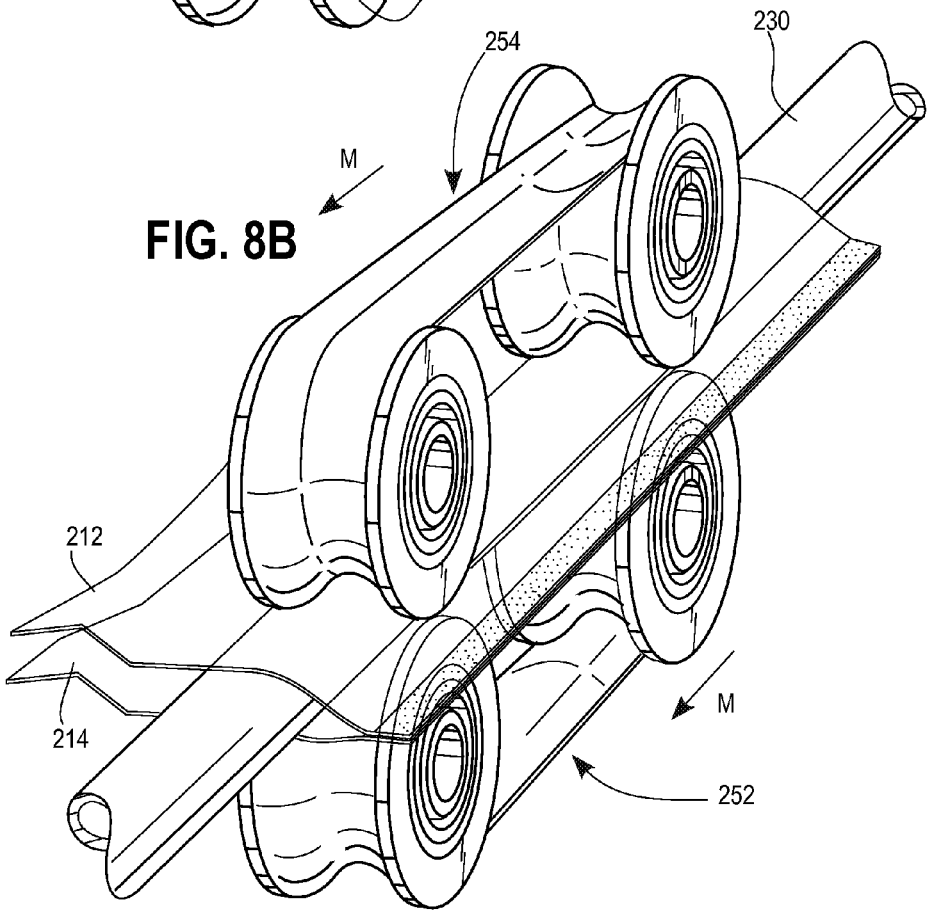
FIG. 8B is a perspective view of a second embodiment of an external roller on the outside of the package.

When a single tube is provided for the vacuum lances 30, 32, 230, 232, 330 and 332, an external pressing device can be provided to press down upon the external or outer surfaces of the films 12, 14, 212, 214, 312 and 314 to push the film taut against the vacuum lance tubes and to prevent the film from getting drawn in at one spot, yet permit the film to continue to advance along the tubes 30, 32, 230, 232, 330 and 332 without getting stuck. In one aspect, this external force can be a pair of external rollers 248 and 250, as shown in FIG. 8A, positioned on or above the vacuum lances 230 or 232, yet contacting the film at an external surface thereof. These rollers 248 and 250 can be stationary in their positioning along the process line, yet roll or move as the film 212 and 214 passes between the rollers 248 and 250. The external rollers 248 and 250 can match the cross-section of the vacuum lance 230 or 232 and can pinch the film 212 and 214 to the lance 230 or 232 while also assisting in moving the film 212 and 214 through the system. In another aspect, a pair of traveling external double rollers 252 and 254 can be provided to travel with the film in the machine direction M, as shown in FIG. 8B. The double rollers 252 and 254 can have a pliable belting material that allows the double rollers 252 and 254 to move with the film 212 and 214 while placed on the vacuum lances 230 or 232.

Optionally, the vacuum lances 230 and 232 can contain one or more small holes 270 in the tube near the open end of the film, i.e., the open end near the partial sealing bars 222 and 224 at the trailing end 244, as seen in FIG. 7. These holes 270 can pull the film onto the surface of the vacuum lances 230 and 232 to provide a substantially airtight seal between the film 212 and 214 and the tubes, thus further sealing any air gap between the film 212 and 214 and the lances 230 and 232 that may be present.

Figure 9A:
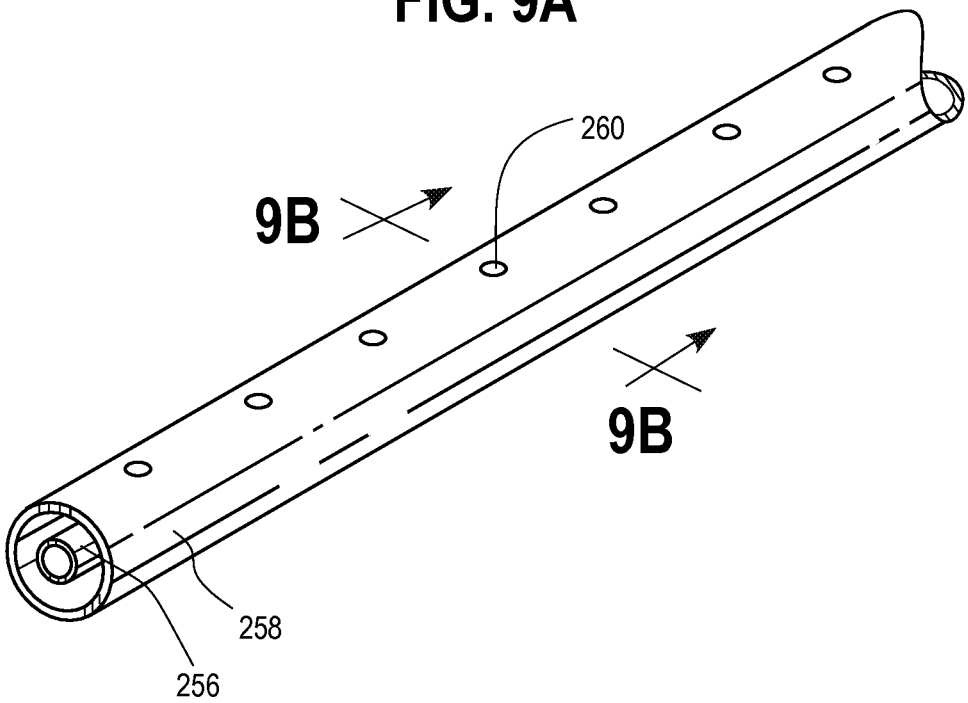
FIG. 9A is a perspective view of one embodiment of a vacuum lance tube.
Figure 9B:
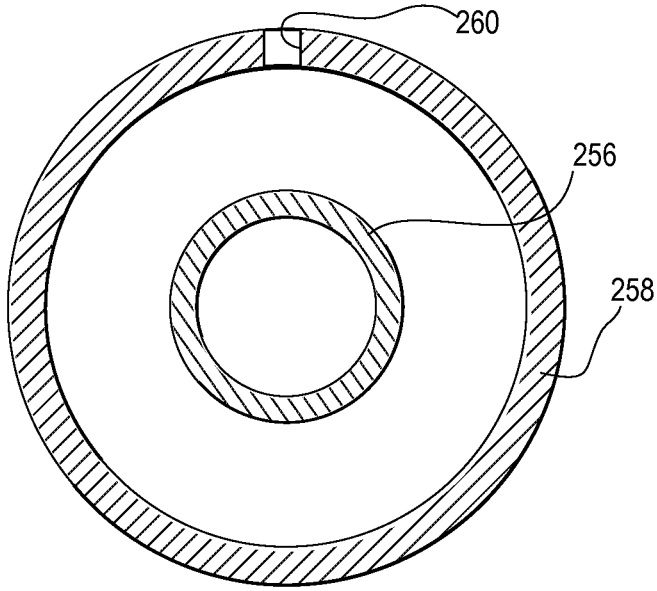
FIG. 9B is a cross-sectional view of the tube of FIG. 9A taken along line 9B-9B.

Yet another approach can comprise a double-tube vacuum lance instead of a single tube; a double-tube lance is shown in FIGS. 9A and 9B. The double-tube arrangement comprises an inner vacuum tube 256 that draws the air from the interior of the package, and an outer vacuum tube 258 that can contain numerous holes 260 along the length of the tube 258, similar to the approach shown in FIG. 3B.

The outer tube 258 can have a separate vacuum source than the inner tube 256, such that each can pull a different amount of vacuum. The outer tube 258 can have a first vacuum that can pull the film 212 or 214 taut to the tube 258 to prevent the film from getting drawn in at one spot, yet still allow the film 212 or 214 to slide relatively smoothly across the vacuum tube 258 when advancing in the machine direction. Therefore, an external force, such as the external rollers shown in FIGS. 8A and 8B are not necessary.

The inner tube 256 can function similarly to the single tube 230 or 232 shown in FIG. 6, where it can pull a second vacuum to evacuate the air inside the package. Other aspects of the process can be similar to that shown in FIG. 6. Any of the different tube variations or features can be applied to any process method used, i.e., pinch roller, partial heat seal or air curtain processes.

In still other approaches, a single vacuum tube can be used where the air restriction is created on and around the vacuum tube, such as using a moveable clamp or the like. The moveable clamp can clamp around the vacuum tube to create a pinch seal that prevents reentry of air which can later be removed during sealing.

The material of construction of the web of film can be any polymer film typically used in this type of packaging process. The dimensions of the package can be any appropriate size for the item being packaged and/or based on the process capabilities. In one aspect, the resulting package can be as small as a candy bar wrapper and as large as up to about a 1 ft. by 2 ft. sized package for wrapping of bulk food products. In place of the heat-sealing bars a second pair of heat-seal rollers can be used, or any other common heat-sealing technique. The sealing bars and sealing rollers can be interchangeable depending upon the process preferences. Where sealing bars are used in place of the sealing rollers the bars can be actuated to move toward each other and retract every so often such that the bars can form cross-wise seals intermittently and at the desired location.

The vacuum lances can have any shape or size that is appropriate for the application and the size package desired. One typical vacuum lance design can have a half-moon shape where the bottom 36 of the lance is relatively flat and the top 31 is rounded, as shown in FIG. 3A. This half-moon shape can also help when the lances are passing through the pinch rollers 22 and 24, since the bottom 36 of the lance that contacts the pinch roller is already flattened. The size, shape and location of the holes, if present, can be such to minimize the differential pressure at any one location in an effort to avoid wrinkling the film. The geometry of the lance can be such that the pinch roller is capable of creating an air tight seal on and around the lance. Optionally, the lances can be flaired out at the end to help maintain cross tension in the web prior to cross-sealing with the heat-sealing bars 26 and 28, 238 and 240, or 338 and 340. The vacuum lances or tubes 30 and 32, 230 and 232, or 330 and 332 can incorporate a low coefficient of friction surface such that the packaging film can easily pass over it without wrinkling or sticking to the lances 30 and 32, 230 and 232, or 330 and 332. The vacuum lances 30 and 32, 230 and 232, or 330 and 332 can be provided in a stationary orientation, while the packaging film travels over the lances 30 and 32, 230 and 232, or 330 and 332.

Optionally, the final heat-sealing bars 26 and 28, 238 and 240, and 338 and 340 can form a single cross-seal that can simultaneously provide both the trailing edge end seal and the leading edge end seal. When the final sealed packages are singulated, the packages can be separated anywhere along the seal such that the seal can then be divided into two seals; a separate trailing edge end seal and a separate leading edge seal.

Any product or item may be sealed within this package that would require evacuation of air (i.e., 20 cc or less). By one approach, food products can be sealed using this technique. The food products used can be any food product that is typically sealed in a vacuum package and may be oxygen sensitive. In one aspect, meat products could be packaged such as bacon, deli meat slices, hot dogs, whole muscle cuts of meat, and the like. In another aspect, food products such as coffee, candy, fruit, vegetables, nuts and cheese may be packaged. By another approach, any oxygen-sensitive, non-food product can be packaged using this method.

From the foregoing, it will be appreciated a vacuum-sealed packaging apparatus and method is provided. However, numerous modifications and variations could be made thereto by those skilled in the art without departing from the scope of the vacuum flow wrap system and method as set forth in the claims. Therefore, the disclosure is not limited to the aspects and embodiments described hereinabove, or to any particular embodiments. Various modifications to the system and method could be made which can result in substantially the same vacuum flow wrapping system.

What is claimed is:

1. An apparatus for forming a vacuum package for enclosing a product therein, comprising:

a film feed station for advancing a top and a bottom film portion in a machine direction;

a product insertion station for conveying a product onto the bottom film portion, overlain with the top film portion;

a longitudinal edge-sealing station for forming a continuous longitudinal side seal between the top and bottom film portions extending downstream from the longitudinal edge-sealing station along an entire length of a longitudinal edge of the top and bottom film portions, an opposite longitudinal edge being closed;

a cross-sealing station positioned downstream of the longitudinal edge-sealing station for sealing the top and bottom film portions together at a leading edge portion downstream of the product for forming a product-receiving interior having a single opening that is at a trailing edge portion, and for later sealing the top and bottom film portions together at the trailing edge portion;

an air restriction station upstream of the cross-sealing station for providing an air barrier at the open trailing edge portion that restricts air flow from a product containing segment disposed between the sealed leading edge and the open trailing edge portions prior to formation of the seal at the open trailing edge portion; and at least one vacuum lance positioned between the top and bottom film portions upstream of the cross-sealing station and extending past the air barrier to evacuate air from within the interior between the top and bottom film portions of the product containing segment.

2. The apparatus of claim 1, wherein the air barrier is a partial seal formed around the vacuum lance.

3. The apparatus of claim 1, wherein the air barrier is a compressed air seal formed by an air compression device that applies compressed air to the trailing edge portion of the top and bottom film portions urging the top and bottom film portions together.

4. The apparatus of claim 1, wherein the air barrier is a pinch seal formed by a pair of pinch rollers.

5. The apparatus of claim 1, wherein two vacuum lances are provided, one along each longitudinal side edge.

6. The apparatus of claim 1, wherein the longitudinal edge-sealing station forms two side seals, one at each opposite longitudinal side edge between the top and bottom film portions.

7. The apparatus of claim 1, wherein the cross-sealing station and air restriction station each comprise a pair of cross-sealing bars and the longitudinal edge-sealing station comprises a pair of side-seal rollers.

8. The apparatus of claim 1, wherein the at least one vacuum lance has multiple holes along part of its length.

9. The apparatus of claim 1, wherein the vacuum lance comprises a double-tubed vacuum lance having an inner tube and an outer tube.

10. The apparatus of claim 9, wherein the inner tube has an opening at an end adjacent the cross-sealing station to pull a vacuum to evacuate the air within the interior section and the outer tube has multiple holes along its length to pull one of the top film or bottom film portions taut against the outer tube.

11. The apparatus of claim 1, wherein an external roller is positioned over the vacuum lance at an external surface of either the top film or the bottom film portions to press the top or bottom film portions onto the vacuum lance.

12. A method of forming a vacuum package containing a food product therein comprising the steps of:

providing a bottom and a top film portion advancing in a machine direction with a food product therebetween;

sealing a longitudinal side edge continuously between the top and bottom film portions, the seal extending in the machine direction along an entire length of the longitudinal side edge between the top and bottom film portions, the other side edge being a closed edge to form closed side edges parallel to the machine direction;

sealing a leading edge portion of the top and bottom film portions downstream of the food product to form a leading edge end seal that is transverse to the machine direction resulting in a partially-sealed package that is closed on three sides and has an open trailing edge portion;

restricting air flow into the partially-sealed package at the open trailing edge portion while withdrawing the air from an interior section of the partially-sealed package to form a substantially airtight interior section between the leading edge end seal, the closed side edges and the trailing edge portion;

sealing the trailing edge portion of the partially-sealed package to form a trailing edge end seal that is transverse to the machine direction to define an enclosed food package; and singulating the food package from the remainder of the top and bottom film portions to result in the final vacuum package.

13. The method of claim 12, further comprising the step of applying compressed air to the trailing edge portion to urge the top and bottom film portions together to restrict the air flow into the partially-sealed package.

14. The method of claim 12, further comprising the step of providing a pinch seal at the trailing edge portion formed by a pair of pinch rollers to restrict the air flow into the partially-sealed package.

15. The method of claim 12, further comprising the step of forming a partial seal at the trailing edge portion to restrict the air flow into the partially-sealed package.

16. The method of claim 12, wherein the step of withdrawing air is carried out by insertion of a vacuum lance into the interior section of the partially-sealed package.

17. The method of claim 16, wherein the vacuum lance is a double tube lance having an outer tube surrounding an inner tube.

18. The method of claim 17, wherein the outer tube has multiple holes along its length and further has a first vacuum that draws the top and bottom film portions down onto an outer surface of the outer tube and the inner tube has a second vacuum that withdraws air from within the interior section of the partially-sealed package.

* * * * *